US011084181B2

(12) United States Patent
Warll

(10) Patent No.: US 11,084,181 B2
(45) Date of Patent: Aug. 10, 2021

(54) ANVIL COVER INSTALLATION METHOD

(71) Applicant: Dicar, Inc., Pine Brook, NJ (US)

(72) Inventor: Stephen Kenneth Warll, New York, NY (US)

(73) Assignee: Dicar, Inc., Pine Brook, NJ (US)

( * ) Notice: Subject to any disclaimer, the term of this patent is extended or adjusted under 35 U.S.C. 154(b) by 0 days.

(21) Appl. No.: 16/591,077

(22) Filed: Oct. 2, 2019

(65) Prior Publication Data

US 2020/0047366 A1 Feb. 13, 2020

Related U.S. Application Data

(62) Division of application No. 15/502,723, filed as application No. PCT/US2014/053136 on Aug. 28, 2014, now Pat. No. 10,478,989.

(51) Int. Cl.

| | |
|---|---|
| ***B26D 7/20*** | (2006.01) |
| ***B26F 1/38*** | (2006.01) |
| ***B26F 1/44*** | (2006.01) |

(52) U.S. Cl.

CPC ..... *B26D 7/204* (2013.01); *B26D 7/20* (2013.01); *B26F 1/384* (2013.01); *B26F 1/44* (2013.01); *B26F 2001/4463* (2013.01)

(58) Field of Classification Search

CPC . B26D 7/204; B26D 7/20; B26F 1/384; B26F 1/44

USPC ..... 83/659, 663, 346–347, 667, 669, 698, 83/698.42, 911

See application file for complete search history.

(56) References Cited

U.S. PATENT DOCUMENTS

| | | | | |
|---|---|---|---|---|
| 4,050,724 A * | 9/1977 | Nakanishi | E05C 3/046 292/241 |
| 4,073,207 A | 2/1978 | Kirkpatrick | |
| 4,075,918 A | 2/1978 | Sauer | |
| 4,378,737 A * | 4/1983 | Kirkpatrick | B26D 7/20 101/415.1 |
| 4,596,546 A * | 6/1986 | Schellenberg | B26F 1/20 101/226 |
| 4,625,612 A * | 12/1986 | Oliver | A21C 11/04 83/346 |

(Continued)

FOREIGN PATENT DOCUMENTS

| | | |
|---|---|---|
| CN | 1307515 A | 8/2001 |
| CN | 1381341 A | 11/2002 |

(Continued)

OTHER PUBLICATIONS

International Search Report for PCT Patent Application No. PCT/US2014/053136 dated Nov. 20, 2014, 20 pages.

(Continued)

*Primary Examiner* — Ghassem Alie
*Assistant Examiner* — Nhat Chieu Q Do
(74) *Attorney, Agent, or Firm* — Lowenstein Sandler LLP

(57) ABSTRACT

A method of installing a sleeve on a die cylinder of a die cutter, the sleeve having a thickness that reduces a gap between the die cylinder and an anvil cylinder of the die cutter. A first locking component of an anvil cover is secured in a locking component receptor of the anvil cylinder and the anvil cylinder is rotated until a second locking component of the anvil cover is pressed by the sleeve to couple with the first locking component in the locking component receptor of the anvil cylinder.

13 Claims, 13 Drawing Sheets

(56) References Cited

U.S. PATENT DOCUMENTS 4,867,024 A 9/1989 Cho et al.
4,878,407 A 11/1989 Harrison et al.
5,027,509 A * 7/1991 Barben ..... B26D 7/2614 29/895.3
5,107,733 A * 4/1992 Palmatier ..... B65H 45/30 271/188
5,138,923 A * 8/1992 Kent ..... B26D 7/2614 403/358
5,156,076 A 10/1992 Rosemann
5,622,113 A * 4/1997 Hansen ..... B26D 1/405 101/415.1
5,906,149 A * 5/1999 Montenegro Criado ..... B26D 7/20 83/659
5,910,203 A * 6/1999 Hauser ..... B23D 57/0053 83/651.1
6,116,135 A * 9/2000 Wagner ..... B26D 7/204 83/698.42
6,135,002 A 10/2000 Neal
6,609,997 B1 8/2003 Sardella et al.
7,565,856 B2 7/2009 Pfaff, Jr.
2001/0047709 A1 12/2001 Jones
2002/0088328 A1 7/2002 Porcella
2007/0000367 A1 1/2007 Pfaff
2010/0307312 A1* 12/2010 Alonso Suarez ..... B26D 7/20 83/698.42
2017/0080645 A1* 3/2017 Workman ..... B32B 27/08

FOREIGN PATENT DOCUMENTS

CN 1549782 A 11/2004
CN 1659003 A 8/2005
EP 1429955 A1 6/2004

OTHER PUBLICATIONS

CN Search Report for Chinese Application No. 2014800814879, dated Feb. 26, 2018, 2 pages.
CN Search Report for Chinese Application No. 2014800814879, dated Nov. 16, 2018, 2 pages.
CN Search Report for Chinese Application No. 2014800814879, dated Jun. 13, 2019, 2 pages.

* cited by examiner

ANVIL COVER INSTALLATION METHOD

CROSS-REFERENCE TO RELATED APPLICATIONS

This application is a divisional application of U.S. patent application Ser. No. 15/502,723, titled "Anvil Cover Installation", filed Feb. 8, 2017, which is a U.S. National Stage application of International Application No. PCT/US2014/053136, filed Aug. 28, 2014, which are hereby incorporated by reference in their entireties.

TECHNICAL FIELD

This disclosure relates to apparatus and method to install an anvil cover on a die cutter, in particular, to the installation of an anvil cover on an anvil cylinder using rotational pressing.

BACKGROUND

A die cutter, either flat or rotary die cutter, may cut sheets of boards on a platform (e.g., a drum or a flatbed), where the boards may be made of corrugated paper, plastic, or other material. For example, a rotary die cutter may include a first cylinder on which cutting knives are installed, and a second cylinder to provide a cutting platform to support the board that is being cut. The first cylinder is commonly referred to as a die cylinder and the second cylinder is commonly referred to as an anvil cylinder, where the die cylinder and the anvil cylinder may be arranged such that the die cylinder is positioned above the anvil cylinder or below the anvil cylinder. A spatial gap may exist between a lowest contour line of the die cylinder and a highest contour line of the anvil cylinder. One or more motors through gears may drive the rotational motion of the die cylinder and anvil cylinder in such a way that a board may feed through the gap between the die cylinder and the anvil cylinder in response to the rotational motion and the frictional force on the surface of the anvil cylinder. The knives installed on the die cylinder may be programmed to cut the board according to pre-programmed patterns via the rotational motion of the die cylinder.

Both the die cylinder and the anvil cylinder may be made from hard materials such as steel. During a cutting process, the knives installed on the die cylinder need to cut through the board. To prevent the blades of the knives from hitting the hard surface of the anvil cylinder, causing damage to the blades, and to protect the surface of the anvil cylinder from scratches, anvil covers may be mounted on the anvil cylinder. In operation, the knives may make contact with and cut into the soft anvil covers, rather than contacting the hard surface of the anvil cylinder.

Anvil covers may be made from durable soft materials such as Urethane. Since a typical anvil cylinder may have a width along the axis direction ranging from 80 to 190 inches with varying diameters, the anvil covers are typically installed in sections of 10 to 20 inches wide individual pieces. For the convenience of discussion, an anvil and an anvil section may be used interchangeably hereinafter. A conventional anvil cylinder may include a horizontal lock channel or a groove across the surface of the anvil cylinder. The groove may be about 1 inch wide by about 0.562 inches deep across the full width of the anvil cylinder. Each anvil cover section includes a first female lock end and a second male lock end.

To install an anvil cover section, a worker typically secures, using bolts or compression force, the female lock end into the lock channel, and then wraps the anvil cover section around the surface of the anvil cylinder. After the anvil cover section is wrapped, a force is applied to the male lock end of the anvil cover section to secure with the female lock end in the lock channel. This is typically done by the worker hitting a hammer or mallet on the male lock end of the anvil cover section with a hammer or mallet. A typical anvil cylinder may need approximately 10 to 12 anvil cover sections to cover the full width of the anvil cylinder.

Additionally, due to uneven wear, anvil cover sections are frequently removed, replaced, and reinstalled in the process known as "anvil cover rotation." Anvil cover rotation is intended to maintain a smoother surface and distribute the wear so as to increase the useful life of anvil cover sections. Wrapping the anvil cover section around the anvil cylinder can be a difficult task because of the limited access space and different physical structures (e.g., bars and shafts) which creates physical barriers and impediments. Also, the anvil cover sections can be difficult to install because significant force is required from a hammer or mallet to complete the installation process. Further, the process to install the anvil cover sections may require the worker to place his or her hands between the anvil cylinder and the die cylinder, which is an occupational hazard.

BRIEF DESCRIPTION OF THE DRAWINGS

The present disclosure is illustrated by way of example, and not by way of limitation, in the figures of the accompanying drawings.

DETAILED DESCRIPTION

Figure 1:
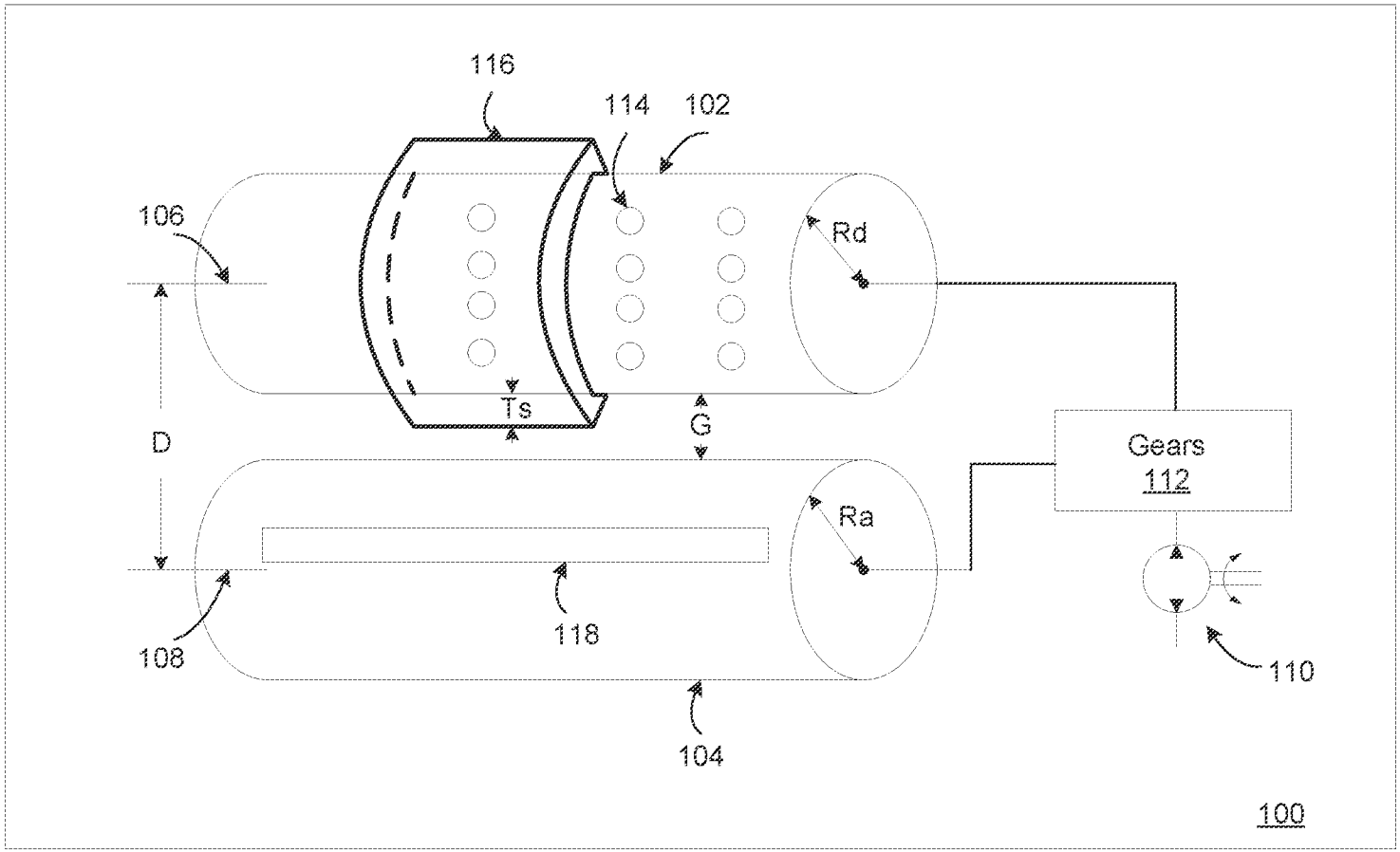
FIG. 1 illustrates a die cutter according to an embodiment of the present disclosure.

Embodiments of the present disclosure relate to a die cutter including an anvil cylinder, a die cylinder, and a sleeve that is mounted on the die cylinder for generating a pressing force on an anvil cover to force a locking component of the anvil cover into a locking component receptor of the anvil cylinder.

Embodiments of the present disclosure also relate to an apparatus including a sleeve mountable on a die cylinder of die cutter for generating a pressing force on an anvil cover to force a locking component of the anvil cover into a locking component receptor of an anvil cylinder of the die cutter.

Embodiments of the present disclosure relate to installing a sleeve on a die cylinder of a die cutter, the sleeve having a thickness that reduces a gap between the die cylinder and an anvil cylinder of the die cutter, securing a first locking component of an anvil cover section in a locking component receptor of the anvil cylinder, and rotating the anvil cylinder until a second locking component of the anvil cover section is pressed by the sleeve to couple with the first locking component in the locking component receptor of the anvil cylinder.

Embodiments of the present disclosure relate to a die cutter including an anvil cylinder for providing a platform for an anvil cover, a shaft, and an eccentric mounted on at least one of the shaft or the anvil cylinder for adjusting a gap between the shaft and the anvil cylinder to be equal to or less than a thickness of the anvil cover, wherein the shaft is to generate a pressing force on the anvil cover to force a locking component of the anvil cover into a locking component receptor of the anvil cylinder.

Embodiments of the present disclosure relate to adjusting a gap between a shaft and an anvil cylinder of a die cutter to be equal to or less than a thickness of an anvil cover to be mounted on the anvil cylinder, securing a first locking component of the anvil cover in a locking component receptor of the anvil cylinder, and rotating the anvil cylinder until a second locking component of the anvil cover is pressed by the shaft to couple with the first locking component in the locking component receptor of the anvil cylinder.

Embodiments of the present disclosure may include a die cutter including a die cylinder for installing cutting knives and an anvil cylinder for providing a platform to support boards being cut. Embodiments of the present disclosure may include fitting the die cylinder of the die cutter with a sleeve configured to reduce a gap between the die cylinder and an anvil cylinder to a level that is less than or equal a thickness of the anvil cover section to be mounted. In an embodiment, the sleeve may cover the complete 360 degree curved surface of the die cylinder. To install an anvil cover section onto the anvil cylinder, a user may first secure a female lock end of an anvil cover section into the lock channel of the anvil cylinder. Subsequently, one or more motors may supply a driving force to rotate both the die cylinder and the anvil cylinder in opposite rotational directions.

In an embodiment, due to the reduced gap space between the die cylinder and the anvil cylinder, the sleeve on the die cylinder may be in contact with a surface of the anvil cover section and apply a persistent press on the anvil cover section through the gap between the die cylinder and anvil cylinder. The persistent press applied by the sleeve forces the anvil cover section to tightly wrap around the anvil cylinder. In an embodiment, when the anvil cylinder makes a complete rotation from the lock channel where the female lock end of the anvil cover section is secured, the male lock end may reach the lock channel. The continued rotations of both the die cylinder and the anvil cylinder cause the sleeve to press the male lock end of the anvil cover section into the lock channel so as to secure the male lock end into the female lock end. In this way, an anvil cover section may be mounted onto an anvil cylinder without the need to hammer the male lock end into the lock channel and without the need to change the design of the anvil cover section or the design of the die cutter.

FIG. 1 illustrates a die cutter 100 according to an embodiment of the present disclosure. As shown in FIG. 1, the die cutter 100 may include a die cylinder 102, an anvil cylinder 104, and a sleeve 116. The die cylinder and the anvil cylinder may be made of suitable materials such as steel, and the sleeve 116 may be made of a suitable material such as wood, plastic, rubber, or other firm materials. The sleeve 116 may be attached to the die cylinder for installing an anvil cover section (not shown) on the anvil cylinder 104, and be detached from the die cylinder 102 during the cutting operation.

The curved outer surfaces of the die cylinder 102 and the anvil cylinder 104 may be considered to have been formed as the trace of a line parallel with an axis and rotating with respect to the axis. Thus, each of the die cylinder 102 and the anvil cylinder 104 may include a respective axis 106, 108 that passes through the respective center of the cylinders 102, 104. In an embodiment, the axes 106, 108 of the die cylinder 102 and the anvil cylinder 104 are substantially parallel to each other, and are also substantially parallel to the ground so that the die cylinder 102 and the anvil cylinder 104 are in substantially horizontal positions. Assuming that the radii of the die cylinder 102 and the anvil cylinder 104 are represented by Rd and Ra, respectively, and that the distance between the axis 106 of the die cylinder 102 and the axis 108 of the anvil cylinder 104 (i.e., the distance from a point on the axis of the die cylinder to the axis of the anvil cylinder) is D. The gap between the die cylinder 102 and the anvil cylinder 104 is represented by the following equation: $G=D-(Rd+Ra)$.

Since the gap should provide for room for both the thickness of the anvil cover section (Ta) and the thickness of a work piece (e.g., a board) (Tb) to be cut by the die cutter 100, G is commonly greater than or equal to Ta+Tb. The anvil cover section and the work piece are not shown in FIG. 1.

In an embodiment, the sleeve 116 may have a thickness (Ts) which reduces the gap (G) between the die cylinder 102 and the anvil cylinder 104 to G-Ts. The reduced gap space G-Ts is less than the thickness of an anvil cover section (Ta).

The die cylinder 102 and anvil cylinder 104 of the die cutter 100 may be driven by one or more motors 110 through one or more gears 112 configured to rotate in opposite rotational directions. For example, if the die cylinder 102 is driven to rotate counter-clockwise, the anvil cylinder 104 is driven to rotate clockwise. The opposite rotational motions between the die cylinder 102 and the anvil cylinder 104 moves the work piece (e.g., a board) to be cut horizontally through the gap between the die cylinder 102 and anvil cylinder 104.

In an embodiment, the die cylinder 102 may include multiple mounting points 114 at which cutting components (e.g., knives) may be installed. In an embodiment, the anvil cylinder 104 may include a receptor 118 (such as a lock channel) for receiving locking components of an anvil cover section. In an embodiment, the receptor 118 may receive a male lock end and a female lock end of the anvil cover section coupled in the receptor 118. The anvil cover section is securely attached to the anvil cylinder when the male lock end and female lock end are coupled inside the receptor 118. One or more anvil cover sections may be installed along the full width of the anvil cylinder 104 to fully cover the anvil cylinder 104 and prevent the knives installed on the die cylinder 102 from hitting the surface of the anvil cylinder 104.

Figure 2:
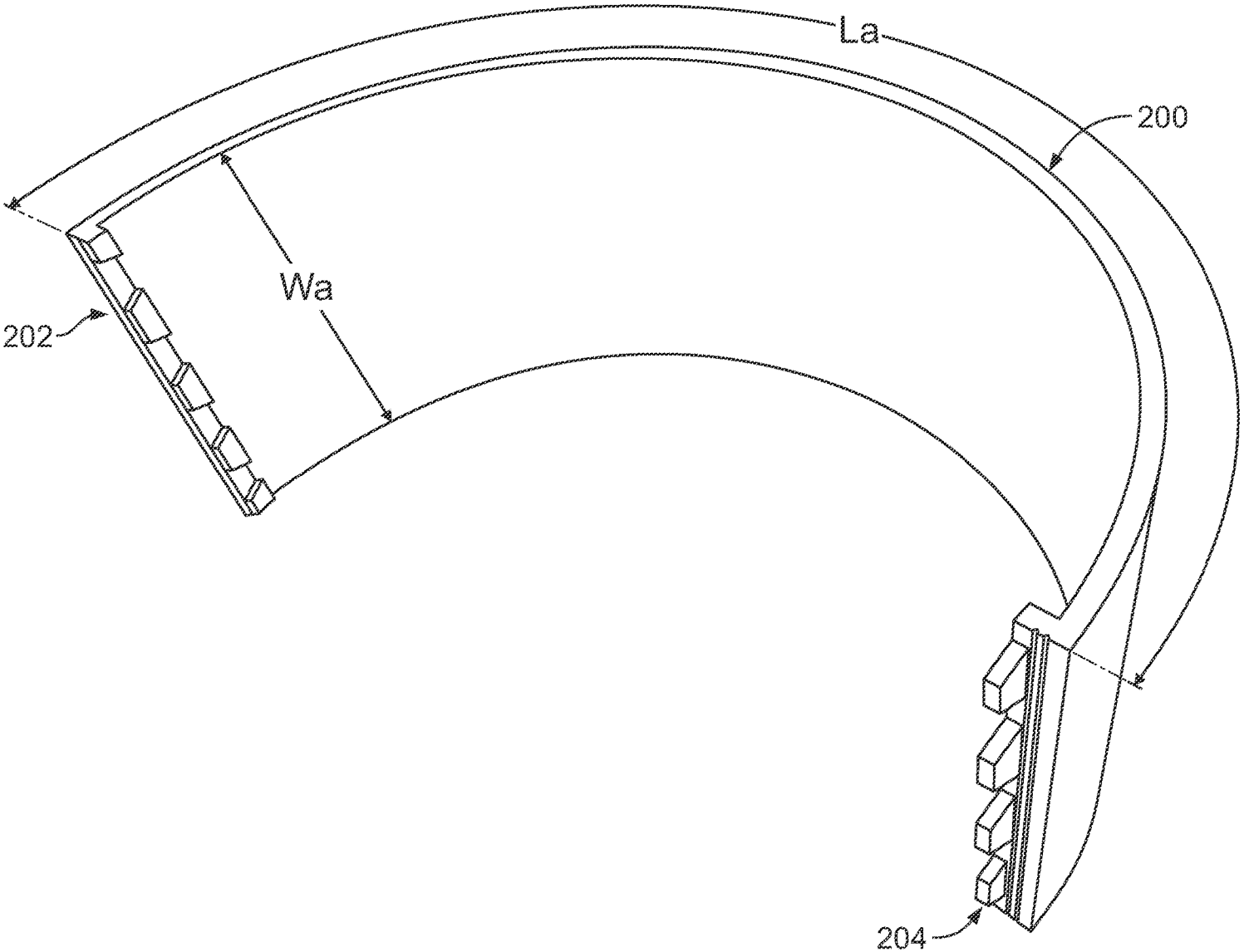
FIG. 2 illustrates an anvil cover section that may be used to protect the anvil cylinder according to an embodiment of the present disclosure.

FIG. 2 illustrates an exemplary anvil cover section 200 that may be used to cover an anvil cylinder and provide a support platform for the board being cut. In an embodiment, the anvil cover section 200 is configured to absorb at least a portion of the cutting components installed on the die cylinder 102. In an embodiment, the anvil cover section 200 may be made from Urethane or any suitable flexible and soft material. The shape of the anvil cover section 200 may be rectangular with a length (La) and a width (Wa). The length (La) of the anvil cover section 200 may match the circumference of the anvil cylinder so that when multiple anvil cover sections are installed side by side, the anvil cover sections cover the substantial entire surface of the anvil cylinder. In an embodiment, each anvil cover section 200 includes a female lock end 202 and a male lock end 204 both configured to fit into a lock channel on the anvil cylinder to secure the anvil cover section 200 onto the anvil cylinder. In an embodiment, the female lock end 202 and the male lock end 204 be coupled in the lock channel to secure the anvil cover section 200 on the anvil cylinder.

Figure 3A:
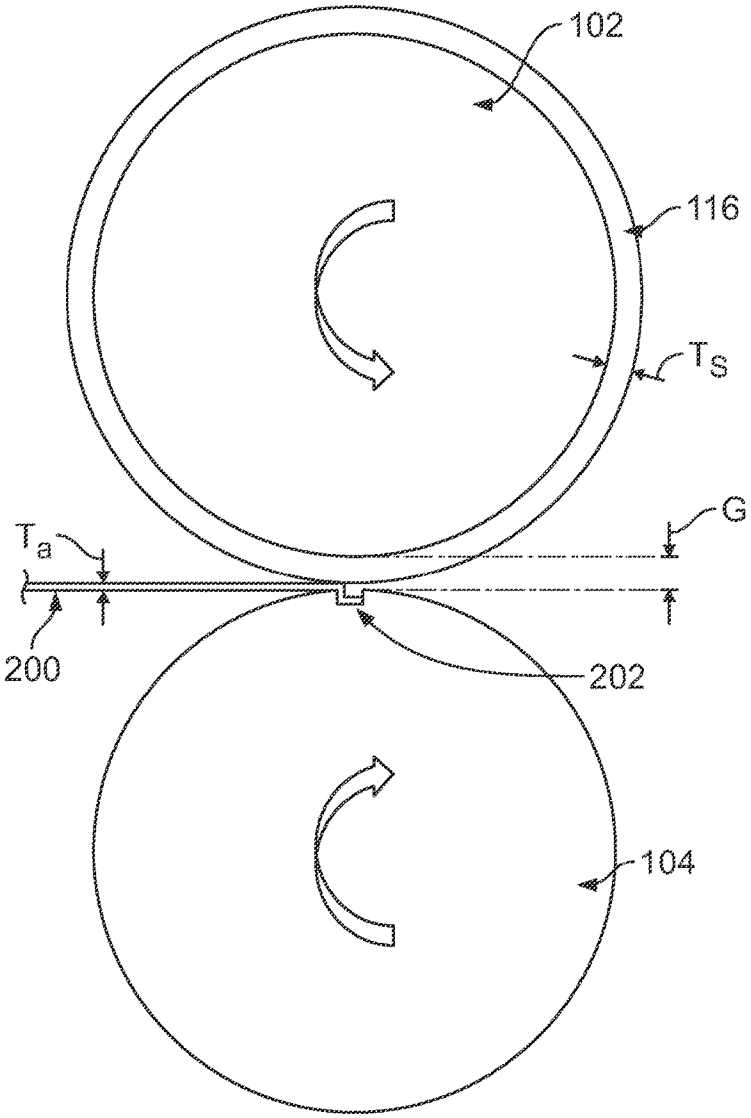
FIGS. 3A-3F illustrate an exemplary process to install an anvil cover section onto an anvil cylinder according to an embodiment of the present disclosure.
Figure 3B:
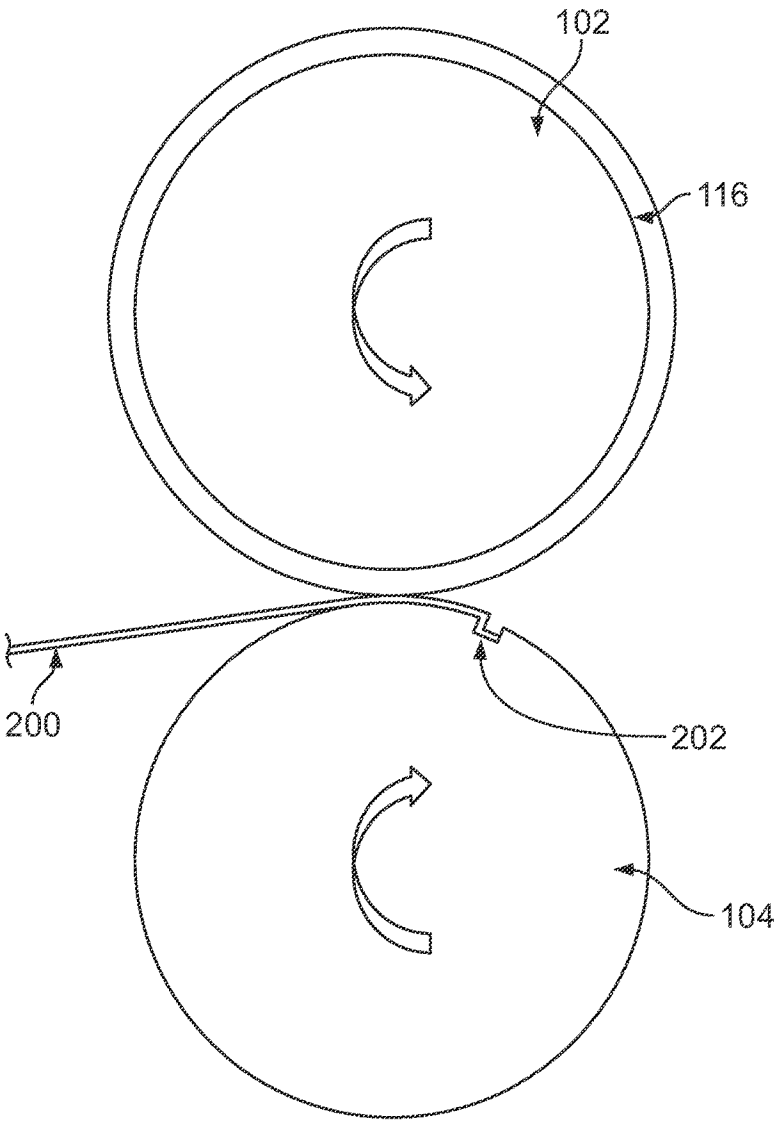
Figure 3C:
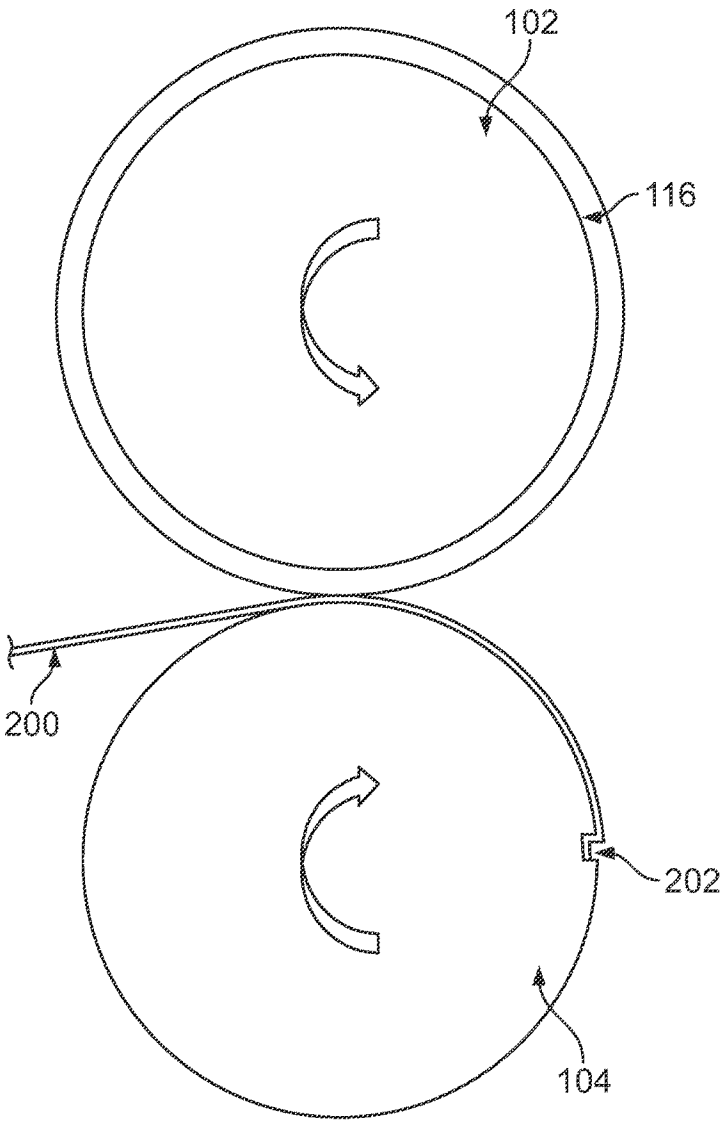
Figure 3D:
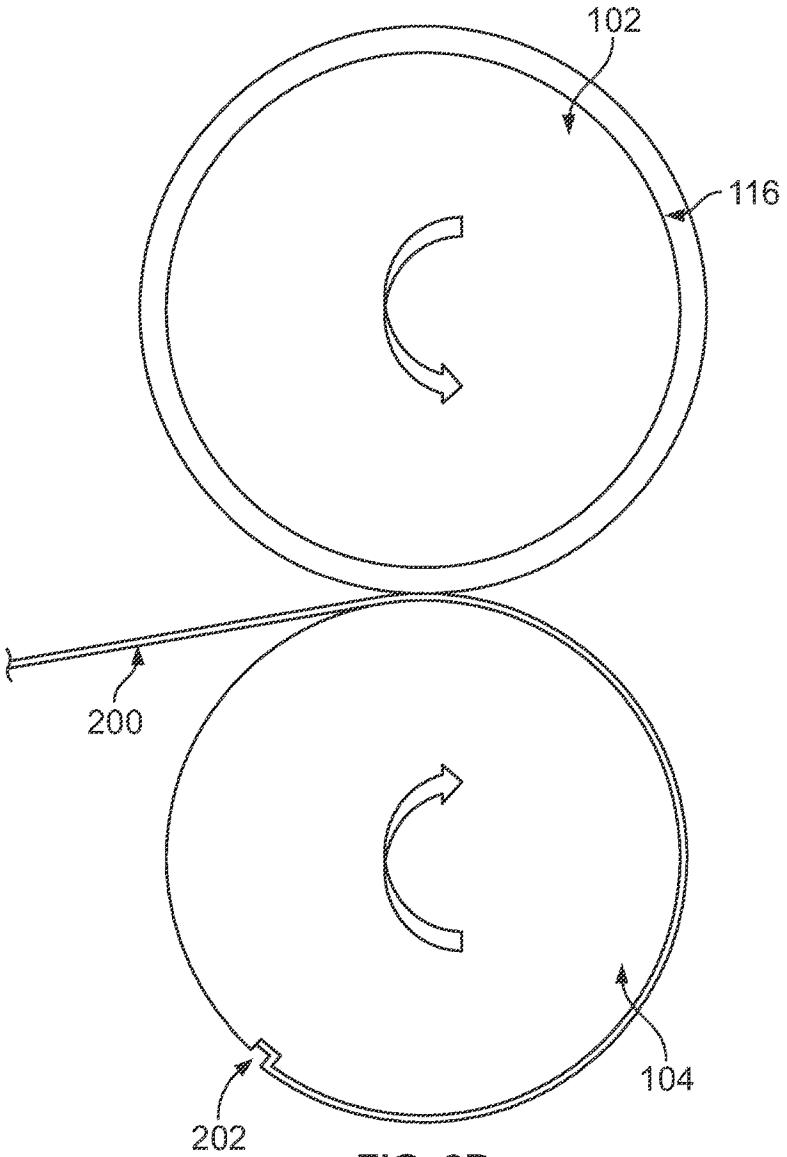
Figure 3E:
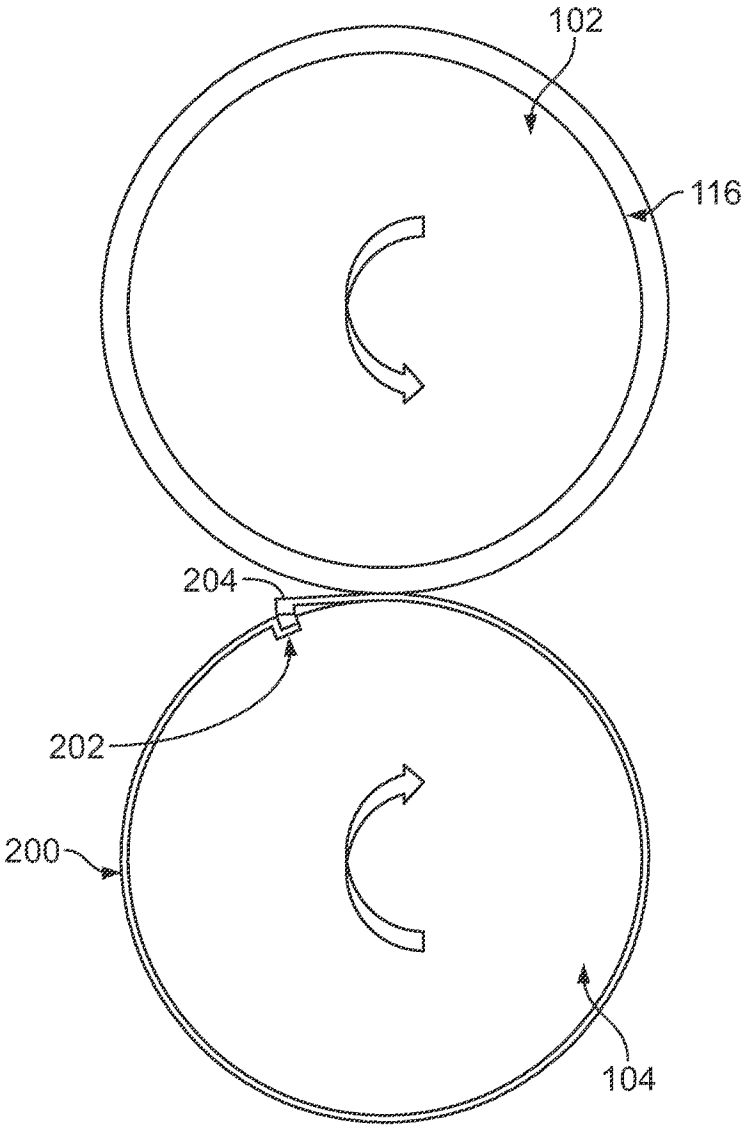

FIGS. 3A-3E illustrate an exemplary method for installing an anvil cover section using a sleeve 116 installed on a die cylinder 102 according to an embodiment of the present disclosure. As shown in FIG. 3A, in an embodiment, a sleeve 116 (having a thickness (Ts)) may be installed on the die cylinder 102. The thickness (Ts) of the sleeve 116 may fill a portion of the gap (G) between the die cylinder 102 and anvil cylinder 104. In an embodiment, after the sleeve 116 is installed on the die cylinder 102, the open space (or the gap) between the die cylinder 102 and the anvil cylinder 104 may be reduced by the thickness (Ts) of the sleeve 116, and the reduced gap may be equal to or less than the thickness (Ta) of the anvil cover section 200 to be mounted on the anvil cylinder 104. In this way, the anvil cover section 200 may be installed by rotating (or indexing) the die cylinder 102 and the anvil cylinder 104.

Referring to FIG. 3A, the female lock end 202 of an anvil cover section 200 may be secured into a lock channel 118 of the anvil cylinder 104. For example, the female lock end 202 may be secured by bolting into the lock channel. Alternatively, the female lock end 202 may be secured by compressing it into the lock channel. After securing the female lock end 202 of the anvil cover section 200 into the lock channel, the die cylinder 102 and the anvil cylinder 104 may be caused to rotate in opposite rotational directions. In the example shown in FIG. 3A, the die cylinder 102 rotates counter clockwise while the anvil cylinder 104 rotates clockwise. Alternatively, only the anvil cylinder 104 is rotated while the die cylinder 102 is left alone. While rotating, the sleeve 116 on the die cylinder may apply a force (e.g., a pressuring or squeezing force) on the anvil cover section 200 so that it may wrap around the anvil cylinder 104. In an embodiment, the rotational speed of the die cylinder 102 may match the rotational speed of the anvil cylinder 104 to reduce or eliminate the stretching along the surface of the anvil cover section 200.

Figure 3F:
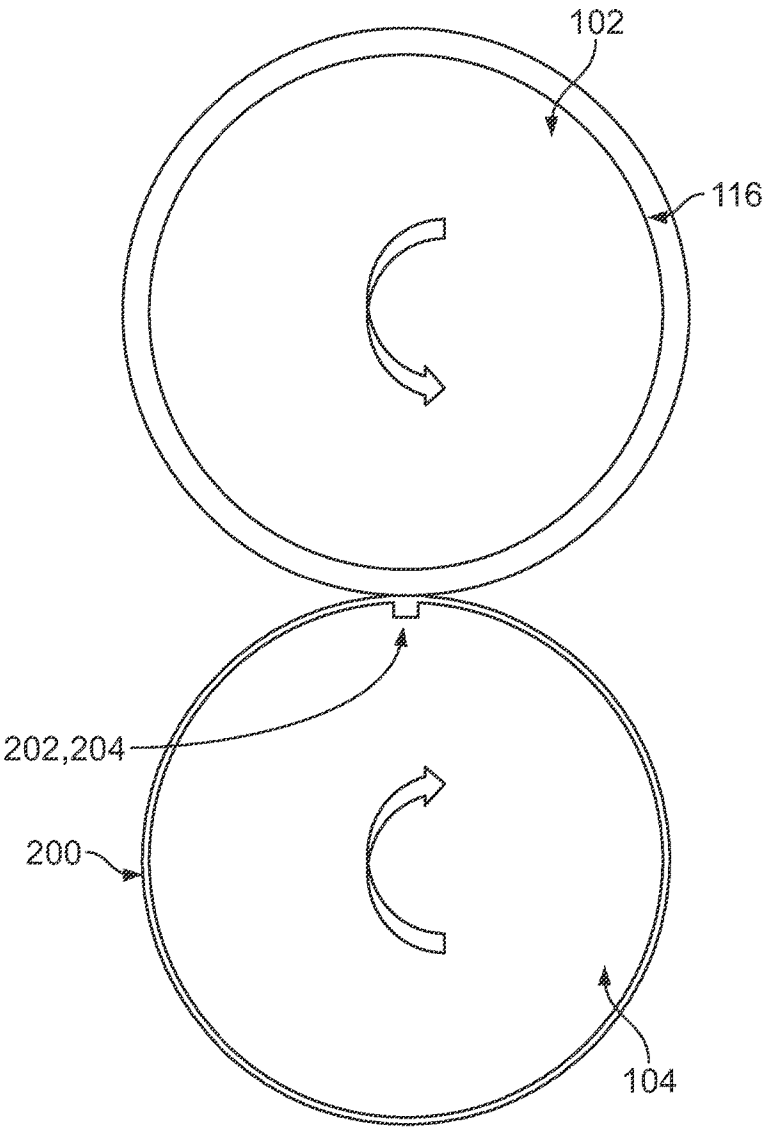

FIGS. 3B-3E illustrate various intermediate points of the process as the die cylinder 102 and the anvil cylinder 104 rotate and the anvil cover 200 is pressed onto the anvil cylinder 104. Since, as discussed above, the length of the anvil cover section 200 substantially matches the circumference of the anvil cylinder 104, the male lock end of the anvil cylinder 104 may be forced towards the lock channel where the female lock end is already secured. As shown in FIG. 3F after the die cylinder 102 and the anvil cylinder 104 rotate 360° from the lock channel where the female lock end is secured, the male lock end may be forced into the lock channel by the pressing force generated by the rotation of the both die cylinder 102 and the anvil cylinder 104. In this way, an anvil cover section 200 may be installed using the natural rotational movements of the anvil cylinder 104 and the die cylinder 102 without the need for an additional external force such as the hammering of the male lock 204 end into the lock channel 118.

In an embodiment, the sleeve 116 may include multiple curved segments each of which may cover the full length or a portion of the curved surface of the die cylinder. The sleeve segments may be made from suitable materials including wood, plastic, rubber, or other firm materials.

Figure 4A:
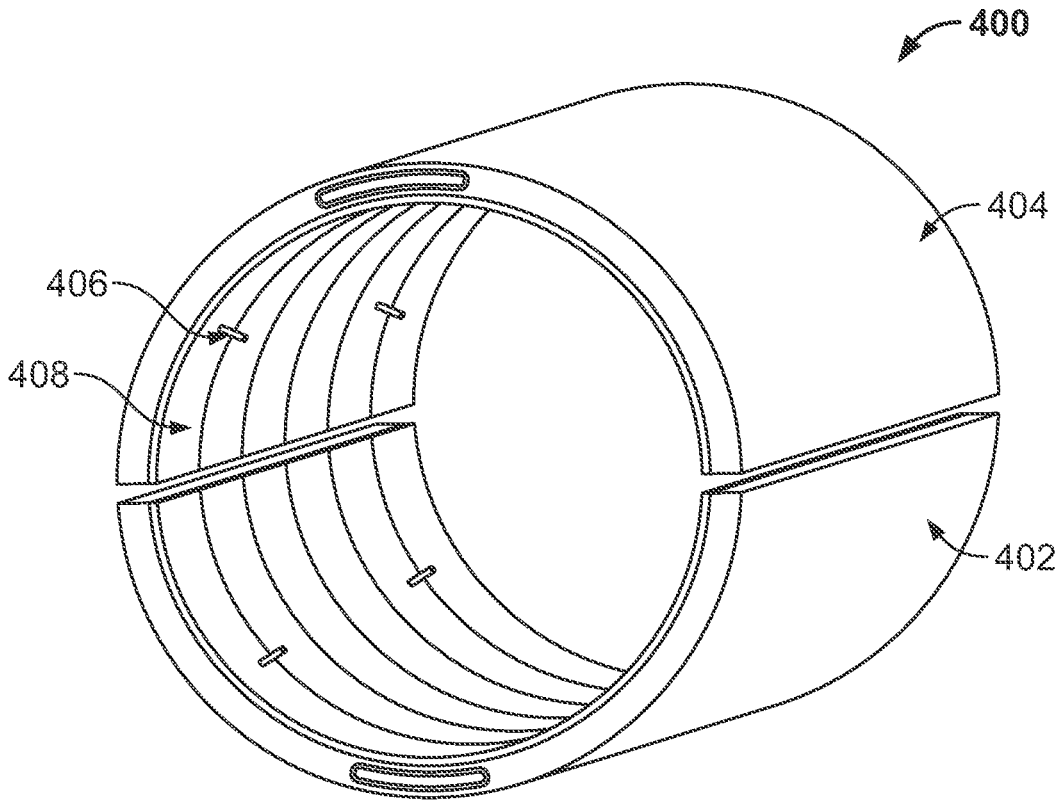
FIGS. 4A-4B illustrate a sleeve for a die cylinder according to embodiments of the present disclosure.
Figure 4B:
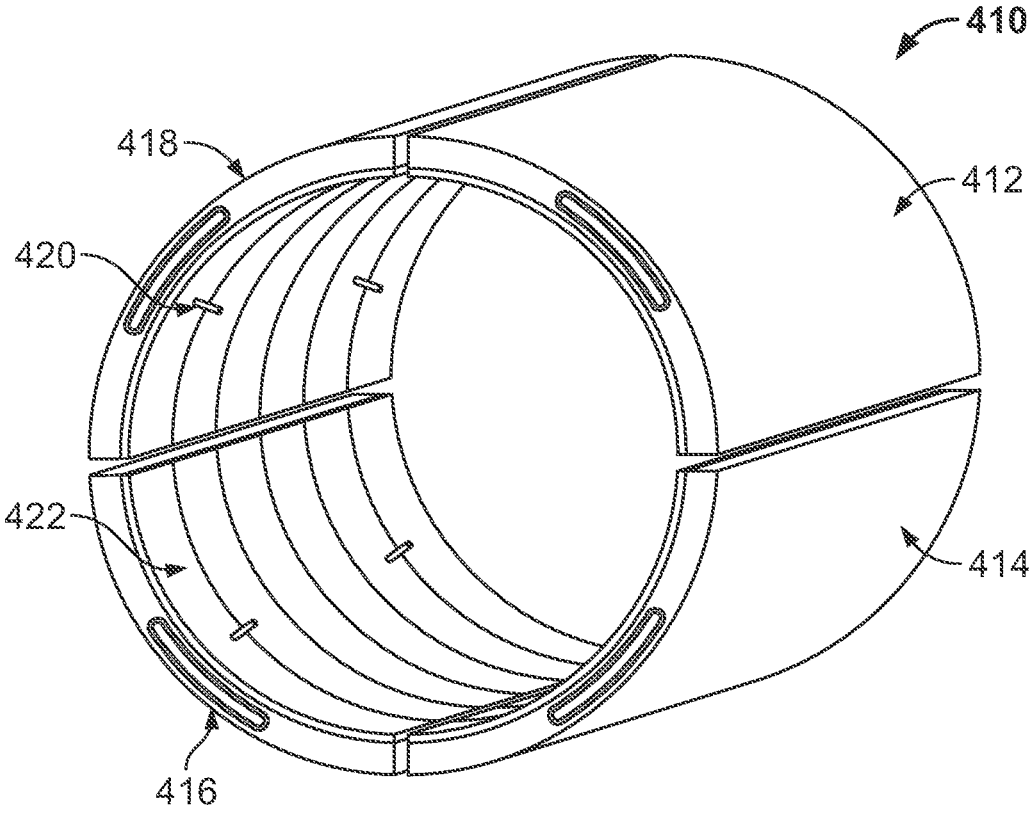

FIGS. 4A-4B illustrate a sleeve formed using sleeve segments according to embodiments of the present disclosure. In an embodiment, the sleeve may be one-piece ring cylinder. In another embodiment, as shown FIG. 4A, a sleeve 400 may include two half-circle sleeve segments 402, 404, wherein each of the sleeve segments having substantially uniform and equal thickness. When put together, the sleeve segments 402, 404 may form a ring cylinder whose inner diameter may be substantially the same as the diameter of the die cylinder so that the sleeve 400 may be tightly mounted on the die cylinder. In an embodiment, the sleeve segments 402, 404 may include a suitable number of mounting holes 406 through which the sleeve segments may be secured or attached to the die cylinder. In another embodiment, a suitable number of magnetic strips 408 may be installed on the inner surface of the sleeve segments 402, 404, which may then be magnetically attached to a die cylinder. The magnetic strips 408 may be attached to the inner surface of the sleeve segments 402, 404 (i.e., the surface that comes into contact with the die cylinder) by a suitable means. In one exemplary embodiment, the magnetic strips 408 may be glued onto the inner surface of the sleeve segments 402, 404.

In an embodiment, the die cylinder may include one or more locking mechanisms to attach segments of sleeve to the die cylinder. For example, the die cylinder may include retrackable pins that may be pushed up from the retreated position to a protruded position to couple with mounting holes 406 on the segments of the sleeve.

FIG. 4B illustrates a sleeve 410 that includes four sleeve segments according to an embodiment of the present disclosure. As shown in FIG. 4B, the sleeve 410 may include four quarter-circle segments 412-418 of substantially equal and uniform thickness which, when put together, form a cylindrical sleeve having inner diameter that is substantially the same as the diameter of the die cylinder. Although FIG. 4A-4B include half-circle and quarter-circle sleeve segments, the sleeve segments can have different shapes so long as they fit and can be installed on the curved surface of the die cylinder.

Figure 5:
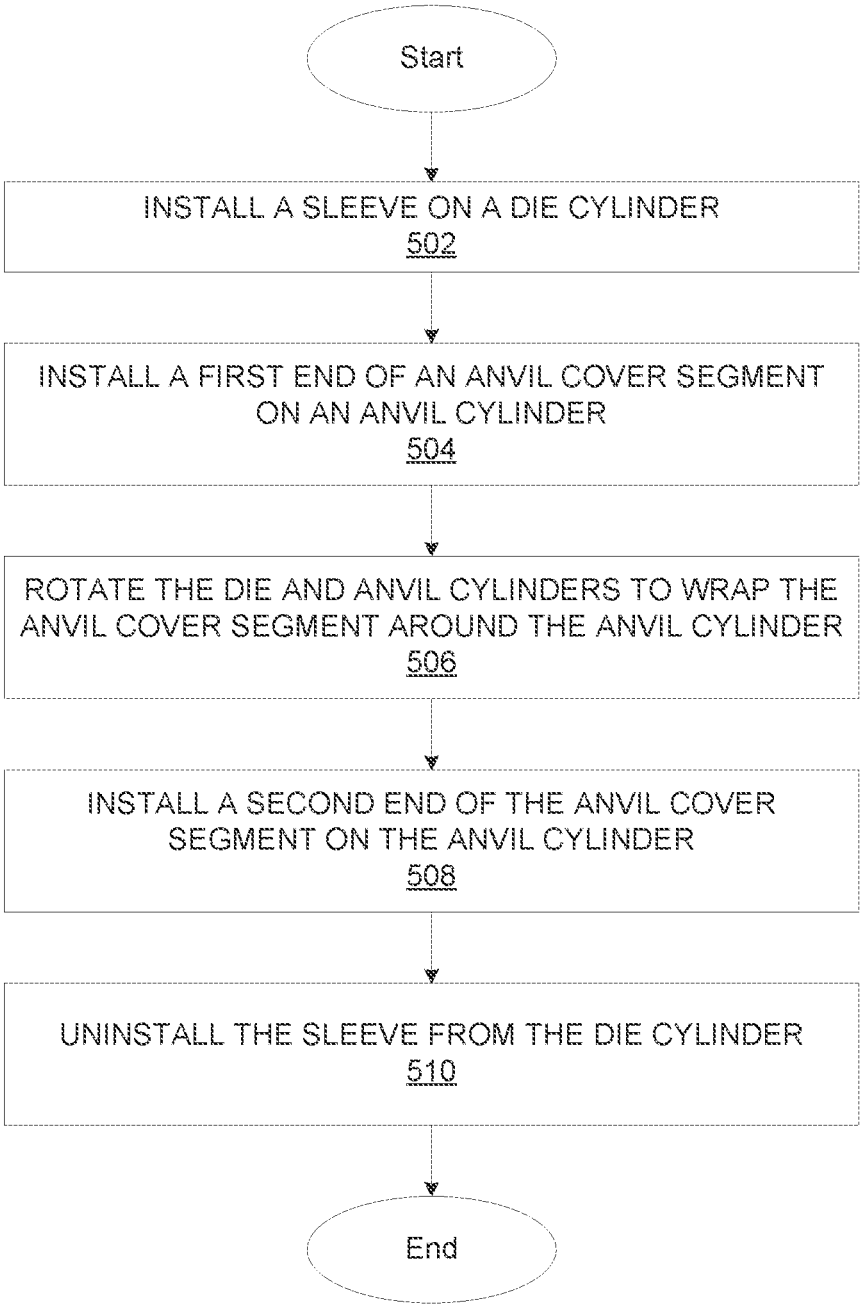
FIG. 5 illustrates an exemplary process to mount an anvil cover section onto an anvil cylinder according to an embodiment of the present disclosure.

FIG. 5 illustrates an exemplary process 500 for mounting an anvil cover section onto an anvil cylinder according to an embodiment of the present disclosure. As discussed above, a die cutter may include a die cylinder and an anvil cylinder. At the start, cutting knives have not installed on the die cylinder. At 502, a one-piece sleeve or a segmented sleeve may be installed on the die cylinder. For a segmented sleeve, sleeve segments of substantially equal and uniform thickness are mounted onto the die cylinder. For example, the sleeve segments may be bolted onto the die cylinder. Alternatively, the sleeve segments may include magnetic strips on their inside surfaces, and the sleeve segments may be magnetically attached to a metal die cylinder. The sleeve segments, when mounted, may form a cylindrical ring that may cover the full length or a section of the die cylinder. Because of the sleeve, the free space between the die cylinder (with the sleeve on) and the anvil cylinder may be reduced to be smaller than the thickness of an anvil cover section to be mounted.

At 504, a first end of an anvil cover section may be secured to a lock channel on the anvil cylinder. For example, the female lock end of the anvil cover section may be compressed into the groove of the lock channel. In an embodiment, the female lock end may be optionally secured or fixedly attached onto the anvil cylinder.

At 506, the anvil cylinder and the die cylinder may be rotated either automatically (such as driven by one or more motors through a gear box) or manually. While the die cylinder with the sleeve and the anvil cylinder rotate due to the rotating, the anvil cover section wraps around the anvil cylinder and the unsecured male lock end of the anvil cover section may follow until the male lock end meets the female lock end at the nip between the die cylinder and the anvil cylinder. Since there is not enough or no room for the male lock end to pass through the gap between the two cylinders, at 508, the male lock end is forced into the lock channel to lock with the female lock end by a force caused from the rotating cylinders.

In an embodiment, the width of the sleeve is substantially the same as or greater than the width of the anvil cover section. Therefore, one anvil cover section may be mounted with one sleeve. In another embodiment, the width of the sleeve is much wider than the width of the anvil cover section. According to embodiments of the present disclosure, multiple anvil cover sections may be mounted with one sleeve.

One or more anvil cover sections may be mounted onto the anvil cylinder to completely cover the surface of the anvil cylinder. Once the anvil cover section is installed, at 510, the sleeve on the die cylinder may be removed so that cutting components may be installed on the die cylinder so that the die cutter may be used to cut work pieces.

Figure 6:
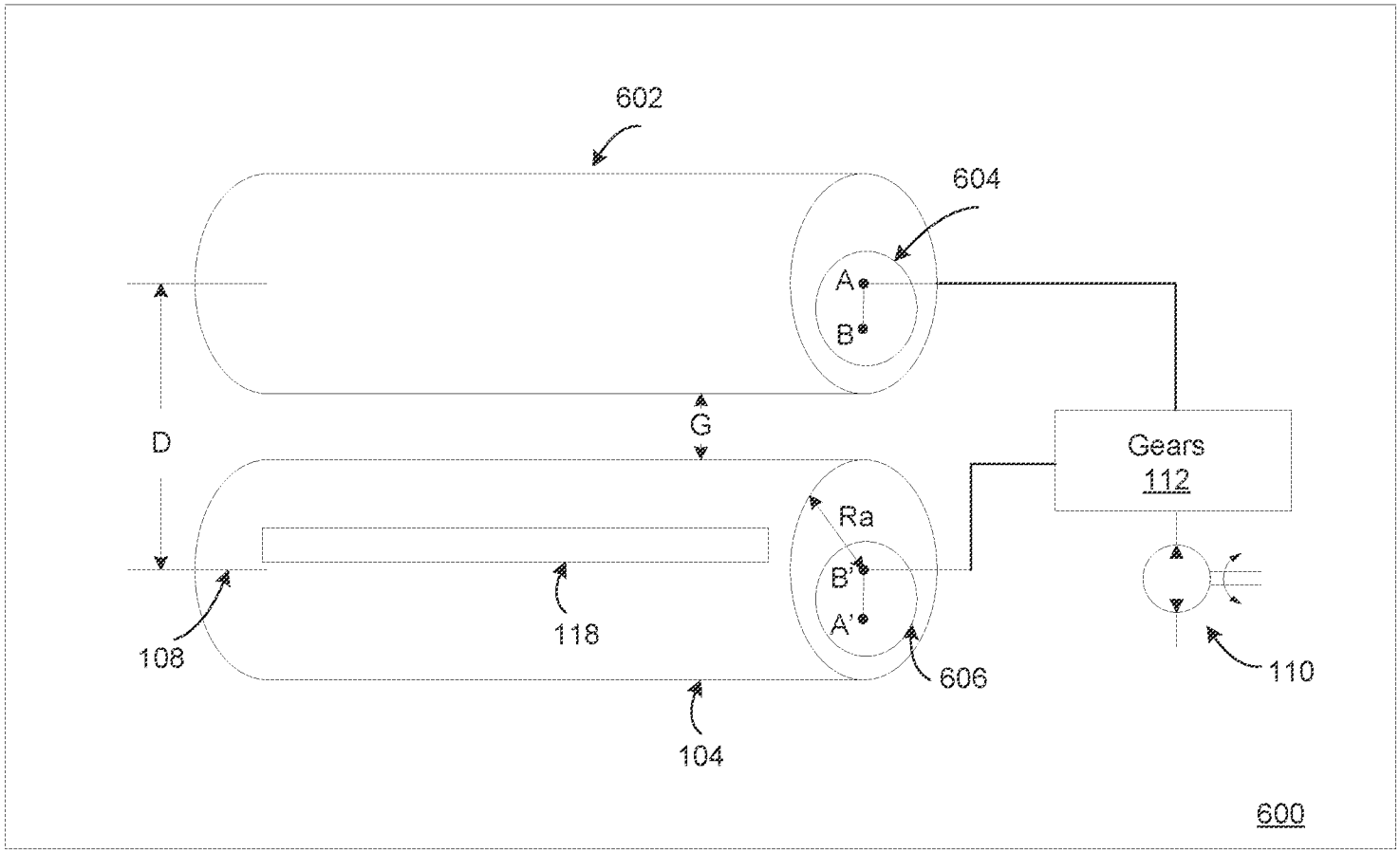
FIG. 6 illustrates a die cutter according to another embodiment of the present disclosure.

In an alternative embodiment, a shaft may be used to generate the pressing force for installing the anvil cover section. FIG. 6 is a die cutter 600 including a shaft 602 for installing an anvil cover section according to an embodiment of the present disclosure.

Referring to FIG. 6, similar to the die cutter 100 as shown in FIG. 1, the die cutter 600 may include anvil cylinder 104 with a lock channel 118, a motor 110, and a gear box 112. The die cutter 600 may further include a shaft 602 and an eccentric 604. A shaft may be a bar made of a solid material such as metal and placed in parallel with the anvil cylinder 108. The position of the shaft 602 may be adjusted through the eccentric 604. By adjusting the eccentric 604, the gap (G) between the shaft 602 and the anvil cylinder 104 may be changed. For example, the shaft 602 may be adjusted from a first position (A) to a second position (B) to reduce the gap (G) between the shaft 602 and the anvil cylinder 104.

In an embodiment, the shaft 602 may be specifically installed or an existing shaft (such as the grind shift) that is already part of the die cutter 600. In an embodiment, the shaft 602 can be the bare die cylinder that has not equipped with the cutting components. Currently, the gap (G) between the die cylinder and the anvil cylinder cannot be adjusted to be closer than the length of a cutting component (such as a cutting knife). To address this issue, in an embodiment of the present disclosure, the eccentric 604 may be modified to be able to adjust the position of the die cylinder to narrow the gap (G) between the die cylinder and the anvil cylinder 104 to be equal to or less than the thickness of an anvil cover section. Alternatively, a second eccentric 606 may be mounted to the anvil cylinder 104 to adjust the position of the anvil cylinder 104 so that the gap (G) may be reduced to be equal to or less than the thickness of an anvil cover section. The eccentrics 604, 606 of the anvil cylinder 104 may be a wheel that is eccentrically mounted on the axis of the shaft 602 or the anvil cylinder 104, through which the gap between the shaft 602 and the anvil cylinder 104 may be adjusted. The eccentrics 604, 606 may be adjusted so that the shaft 604 may contact the anvil cover section to be installed and provide the press (or squeeze) on the anvil cover section to force the male lock end of the anvil cover section into the lock channel of the anvil cylinder 104.

The positions of the shaft 602 (or the bare die cylinder) may be adjusted to be close to the anvil cylinder so that they can be used to press on an anvil cover section. Similar to the sleeve installed on the die cylinder, the shaft (or the bare die cylinder) may be used to force the anvil cover section on to the anvil cylinder. However, unlike the sleeve installed on a die cylinder, the shaft (or the bare die cylinder) does not need an additional sleeve to reduce the gap (G) between the shaft/die cylinder and the anvil cylinder. Instead, the gap (G) is reduced by adjusting the eccentric 604.

In an embodiment, both the shaft 602 (or the bare die cylinder) and the anvil cylinder 104 of the die cutter 600 may be coupled to one or more motors 110 through the gear box 112 so that the shaft 602 may rotate at a rotational speed matching that of the anvil cylinder. In this way, an anvil cover section may be installed on the anvil cylinder using the rotational press generated by rotating the shaft 602 and the anvil cylinder 104.

Figure 7:
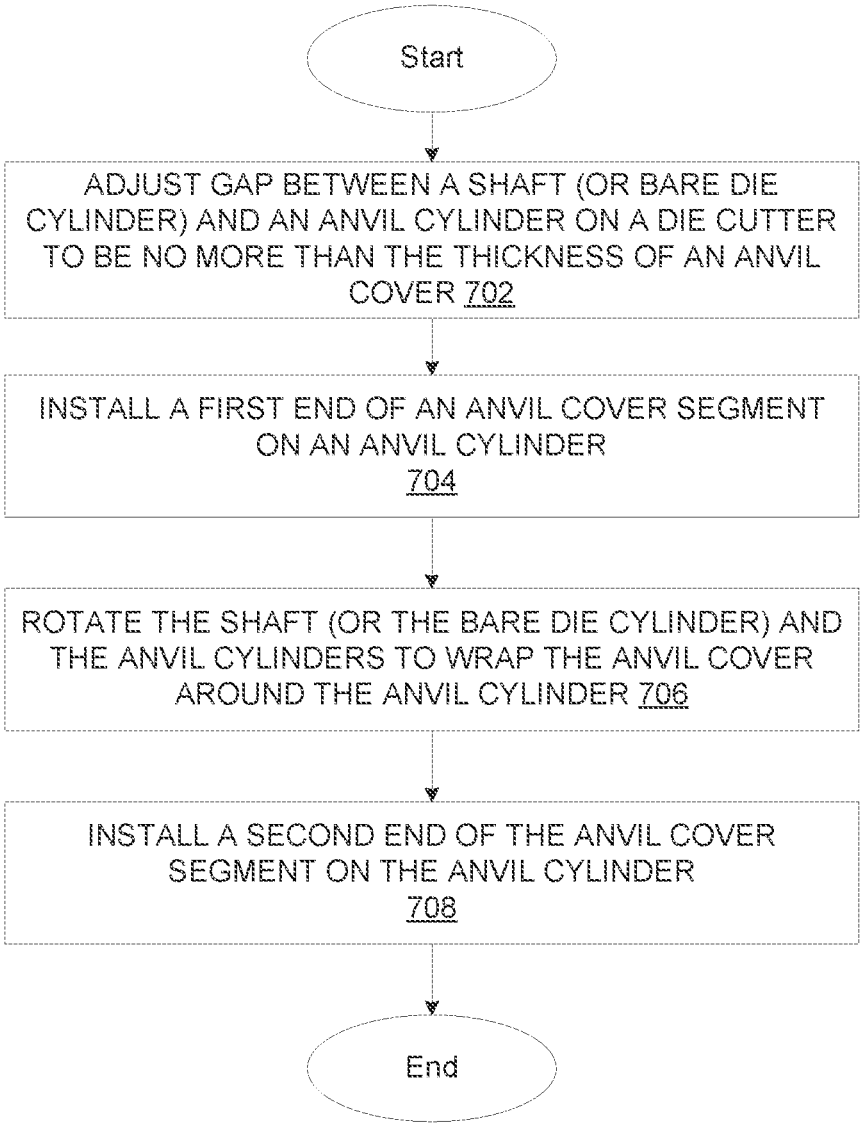
FIG. 7 illustrates an exemplary process to mount an anvil cover section onto an anvil cylinder using a shaft or a bare die cylinder according to an embodiment of the present disclosure.

FIG. 7 is illustrates an exemplary process for mounting an anvil cover section onto an anvil cylinder using a shaft or bare die cylinder according to an embodiment of the present disclosure. Referring to FIG. 7, at 702, the position of a shaft or bare die cylinder may be adjusted to the anvil cylinder. The shaft may be parallel to the anvil cylinder. In an embodiment, the gap between the shaft (or the bare die cylinder) and the anvil cylinder may be adjusted through an eccentric. After the adjustment, the gap may be equal to or smaller than the thickness of an anvil cover section.

At 704, a first end of an anvil cover section may be secured to a lock channel on the anvil cylinder. For example, the female lock end of the anvil cover section may be compressed into the groove of the lock channel. In an embodiment, the female lock end may be optionally bolted onto the anvil cylinder.

At 706, the anvil cylinder and the shaft or the bare die cylinder may be rotated either automatically (such as driven by one or more motors through a gear box) or manually. While the anvil cylinder and the shaft (or the bare die cylinder) rotate due to the rotating, the anvil cover section wraps around the anvil cylinder and the unsecured male lock end of the anvil cover section may follow until the male lock end meets the female lock end by the shaft or the bare die cylinder. Since there is no room for the male lock end to pass through the gap between the two cylinders, at 708, the male lock end is forced into the lock channel to couple with the female lock end by pressure caused from the rotating shaft (or the bare die cylinder) and anvil cylinder.

In an embodiment, the width of the sleeve is substantially the same as the width of the anvil cover section. Therefore, one anvil cover section may be mounted with one sleeve. In another embodiment, the width of the sleeve is much wider than the width of the anvil cover section. Therefore, multiple anvil cover sections may be mounted with one sleeve.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "an embodiment" or "an implementation" or "one implementation" throughout is not intended to mean the same embodiment or implementation unless described as such.

Reference throughout this specification to "an embodiment" or "an embodiment" means that a particular feature, structure, or characteristic described in connection with the embodiment is included in at least an embodiment. Thus, the appearance of the phrases "in an embodiment" or "in an embodiment" in various places throughout this specification are not necessarily all referring to the same embodiment. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A method for installing an anvil cover on an anvil cylinder comprising:

providing a die cylinder including a plurality of mounting points for installing at least one cutting component;

installing a sleeve on the die cylinder of a die cutter, the sleeve having a thickness that reduces a gap between the die cylinder and the anvil cylinder of the die cutter;

securing a first locking component of the anvil cover in a locking component receptor of the anvil cylinder;

rotating the anvil cylinder to cause a second locking component of the anvil cover to be pressed by the sleeve to couple with the first locking component in the locking component receptor of the anvil cylinder;

uninstalling the sleeve from the die cylinder; and installing the at least one cutting component on the die cutter.

2. The method of claim 1, further comprising performing, using the at least one cutting component, a cutting operation.

3. The method of claim 1, wherein the first locking component comprises a male lock end of the anvil cover and the second locking component comprises a female lock end of the anvil cover, wherein the locking component receptor comprises a lock channel on the anvil cylinder.

4. The method of claim 1, wherein the sleeve comprises a plurality of segments, and wherein the plurality of segments form a ring cylinder.

5. The method of claim 1, wherein the reduced gap is less than a thickness of the anvil cover.

6. The method of claim 1, wherein a first segment of the sleeve comprises at least one mounting hole through which the first segment of the sleeve is fixedly attached to the die cylinder.

7. The method of claim 1, wherein a first segment of the sleeve comprises at least one magnetic component by which the first segment of the sleeve is magnetically attached to the die cylinder.

8. The method of claim 1, wherein the anvil cylinder comprises a horizontal lock channel.

9. The method of claim 1, wherein the sleeve comprising a magnetic component configured to removably magnetically attach to the die cylinder.

10. A method for installing an anvil cover on an anvil cylinder comprising:

applying a sleeve to a die cylinder comprising a plurality of mounting points for installing cutting components, wherein the sleeve covers at least one of the plurality of mounting points;

rotating, by a motor, the anvil cylinder to cause the sleeve to generate a pressing force on the anvil cover to force a locking component of the anvil cover into a horizontal lock channel of the anvil cylinder to secure the anvil cover on the anvil cylinder;

removing the sleeve from the die cylinder; and installing at least one cutting component of the cutting components to at least one of the plurality of mounting points of the die cylinder.

11. The method of claim 10, wherein the sleeve has a thickness that reduces a gap between the die cylinder and the anvil cylinder.

12. The method of claim 10, further comprising performing a cutting operation using the at least one cutting component.

13. The method of claim 10, further comprising attaching the sleeve to the die cylinder via at least one mounting hole of the sleeve.

* * * * *